US009881723B1

(12) United States Patent
Jaski et al.

(10) Patent No.: US 9,881,723 B1
(45) Date of Patent: Jan. 30, 2018

(54) EIGHT PIECE QUADRUPOLE MAGNET, METHOD FOR ALIGNING QUADRUPOLE MAGENT POLE TIPS

(71) Applicants: Mark S. Jaski, Palos Park, IL (US); Jie Liu, Naperville, IL (US); Aric T. Donnelly, Bolingbrook, IL (US); Joshua S. Downey, Montgomery, IL (US); Jeremy J. Nudell, Forest Park, IL (US); Animesh Jain, Plainfield, IL (US)

(72) Inventors: Mark S. Jaski, Palos Park, IL (US); Jie Liu, Naperville, IL (US); Aric T. Donnelly, Bolingbrook, IL (US); Joshua S. Downey, Montgomery, IL (US); Jeremy J. Nudell, Forest Park, IL (US); Animesh Jain, Plainfield, IL (US)

(73) Assignee: UCHICAGO ARGONNE, LLC, Chicago, IL (US)

( * ) Notice: Subject to any disclaimer, the term of this patent is extended or adjusted under 35 U.S.C. 154(b) by 0 days.

(21) Appl. No.: 15/406,437

(22) Filed: Jan. 13, 2017

(51) Int. Cl.
*H01F 7/02* (2006.01)
*H01F 41/02* (2006.01)

(52) U.S. Cl.
CPC ..... *H01F 7/021* (2013.01); *H01F 41/0253* (2013.01)

(58) Field of Classification Search
CPC ..... H01F 41/0253; H01F 7/021
See application file for complete search history.

(56) References Cited

U.S. PATENT DOCUMENTS 3,568,115 A * 3/1971 Wolfe ..... H01F 7/021 250/423 R

FOREIGN PATENT DOCUMENTS

DE 2011274 A1 * 10/1970 ..... H01F 7/021

* cited by examiner

*Primary Examiner* — Mohamad Musleh
(74) *Attorney, Agent, or Firm* — Cherskov Flaynik & Gurda, LLC

(57) ABSTRACT

The invention provides an alternative to the standard 2-piece or 4-piece quadrupole. For example, an 8-piece and a 10-piece quadrupole are provided whereby the tips of each pole may be adjustable. Also provided is a method for producing a quadrupole using standard machining techniques but which results in a final tolerance accuracy of the resulting construct which is better than that obtained using standard machining techniques.

20 Claims, 8 Drawing Sheets

EIGHT PIECE QUADRUPOLE MAGNET, METHOD FOR ALIGNING QUADRUPOLE MAGENT POLE TIPS

CONTRACTUAL ORIGIN OF THE INVENTION

The U.S. Government has rights in this invention pursuant to Contract No. DE-AC02-06CH11357 between the U.S. Department of Energy and UChicago Argonne, LLC, representing Argonne National Laboratory.

BACKGROUND OF THE INVENTION

1. Field of the Invention

This invention relates to quadrupole magnets and more specifically, this invention relates to a quadrupole magnet comprising separate pole tips to allow fine tuning of the quadrupole at assembly.

2. Background of the Invention

Quadrupole magnets are used in many applications involving focusing of a charged particle beam. Some applications require a few quadrupole magnets while large accelerators can use several hundred quadrupole magnets.

Quadrupole magnet pole tips need to be positioned accurately, or large multipole errors will occur. Four piece quadrupoles have been used in many applications.

FIG. 1 depicts a standard quadrupole arrangement with four poles, 1 through 4, opposing each other. This opposition defines the periphery of an aperture 20 through which a charged particle beam travels. The poles, when magnetized, cause the electrons to deviate in trajectory, thereby providing a means to focus the beam. However, for accurate focusing, the distances between the tips of opposing poles and the gaps between adjacent poles must be tightly controlled (e.g., within about 10 microns).

Typically, each of the poles and their tips are individually machined as one unit or monolith (such that the tips are integrally molded to the pole body). This individual machining of each pole represents a large number of surfaces and a stackup of tolerances. Therefore, rigorous machining tolerances are required, but not always obtained.

The arrows in FIG. 1 show how the position of the poles can inadvertently vary from each other, depending on machining imperfections. For example, the ends of the poles can be closer than intended. One or more of the poles may be rotated about its longitudinal or transverse axis. One or more poles may be laterally misplaced.

Inasmuch as the tips predominantly define the magnetic field quality inside the channel 20 through which a charged particle beam passes for focusing, accurate pole positioning is crucial. Very tight machining tolerances are needed to keep these positioning errors small.

Standard quadrupole magnet assembly has hit a wall. While researchers require tolerances of 10 microns or less to assure consistent and accurate focusing of beams, standard machine shop tolerances are about 50 microns. Given the tight tolerance requirements of quadrupole systems, many machine shops do not bid for the work.

Those machine shops who do the jobs expend inordinate resources to achieve the required tolerances. This increases the cost significantly for the two- or four-piece quadrupole magnets. The alignment is still not optimal such that shimming often needs to be employed to more accurately align these heavy pieces, potentially weighing more than 4000 pounds in some cases.

A need exists in the art for a quadrupole magnet design and method for assembling parts of a quadrupole magnet that confers 10 micron assembly tolerance. The magnet design and assembly method should utilize standard machine shop limitations so as to be economical. The method should also allow for adjustment of initially assembled multi-pole configurations to accommodate different power levels, focusing geometries, and in instances where a plurality of quadrupoles are used, path trajectories.

SUMMARY OF INVENTION

An object of the invention is to provide a quadrupole system and method of assembly that overcomes many of the drawbacks of the prior art.

Another object of the invention is to provide a method for building focusing magnets for modern particle accelerators. A feature of an embodiment of the invention is utilizing a quadrupole magnet configuration comprising a plurality of (e.g., 5, 6, 7, 8, etc.) distinct and replaceable pieces. An advantage of the invention is that it achieves tighter assembly tolerances (e.g. approximately 10 microns) without requiring expensive machining methods and it enables precise assembly in instances where more precise machining is impractical.

Still another object of the present invention is to provide a quadrupole magnet. A feature of the quadrupole magnet is that it comprises eight distinct pieces, including four pole main bodies and four pole tips. An advantage of the invention is that imprecise fabrication of the main bodies and the pole tips are accommodated by independent adjustment of any or all of the pole tips and pole main bodies to achieve desired configurations of the aperture through which charged particle beams pass for focusing.

Briefly, the invention provides a method for aligning a multi-pole magnet, the method comprising initially positioning all poles such that each pole directly opposes another pole, thereby forming gaps between the poles; measuring the gaps between the poles and select separation or spacing substrates whose cross section diameters approximate the gaps, minus 10 microns; inserting the substrates in the gaps; assembling the multi-pole magnet while simultaneously assuring contact between the poles and the spacing substrates; and removing the spacing substrates.

Also provided is a quadrupole comprising a first pole and a second pole in opposition to the first pole such that the first pole and second pole are collinear so as to define a first line, whereby the first pole comprises a first main body terminating in an adjustable first tip and the second pole comprises a second main body terminating in an adjustable second tip; a third pole comprising a third main body terminating in a third tip and a fourth pole comprising a fourth main body terminating in a fourth tip in opposition to each other such that the third pole and the fourth pole are collinear so as to define a second line that is generally orthogonal to the first direction so as to form a first channel extending between the first pole, second pole, third pole, and fourth pole and a second channel between the first pole, second pole, third pole, and fourth pole wherein the second channel is orthogonal to the first channel.

BRIEF DESCRIPTION OF DRAWING

The invention together with the above and other objects and advantages will be best understood from the following detailed description of the preferred embodiment of the invention shown in the accompanying drawings, wherein.

DETAILED DESCRIPTION OF THE INVENTION

The foregoing summary, as well as the following detailed description of certain embodiments of the present invention, will be better understood when read in conjunction with the appended drawings.

All numeric values are herein assumed to be modified by the term "about", whether or not explicitly indicated. The term "about" generally refers to a range of numbers that one of skill in the art would consider equivalent to the recited value (e.g., having the same function or result). In many instances, the terms "about" may include numbers that are rounded to the nearest significant figure.

The recitation of numerical ranges by endpoints includes all numbers within that range (e.g. 1 to 5 includes 1, 1.5, 2, 2.75, 3, 3.80, 4, and 5).

The following detailed description should be read with reference to the drawings in which similar elements in different drawings are numbered the same. The drawings, which are not necessarily to scale, depict illustrative embodiments and are not intended to limit the scope of the invention.

As used herein, an element or step recited in the singular and preceded with the word "a" or "an" should be understood as not excluding plural said elements or steps, unless such exclusion is explicitly stated. As used in this specification and the appended claims, the term "or" is generally employed in its sense including "and/or" unless the content clearly dictates otherwise.

Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
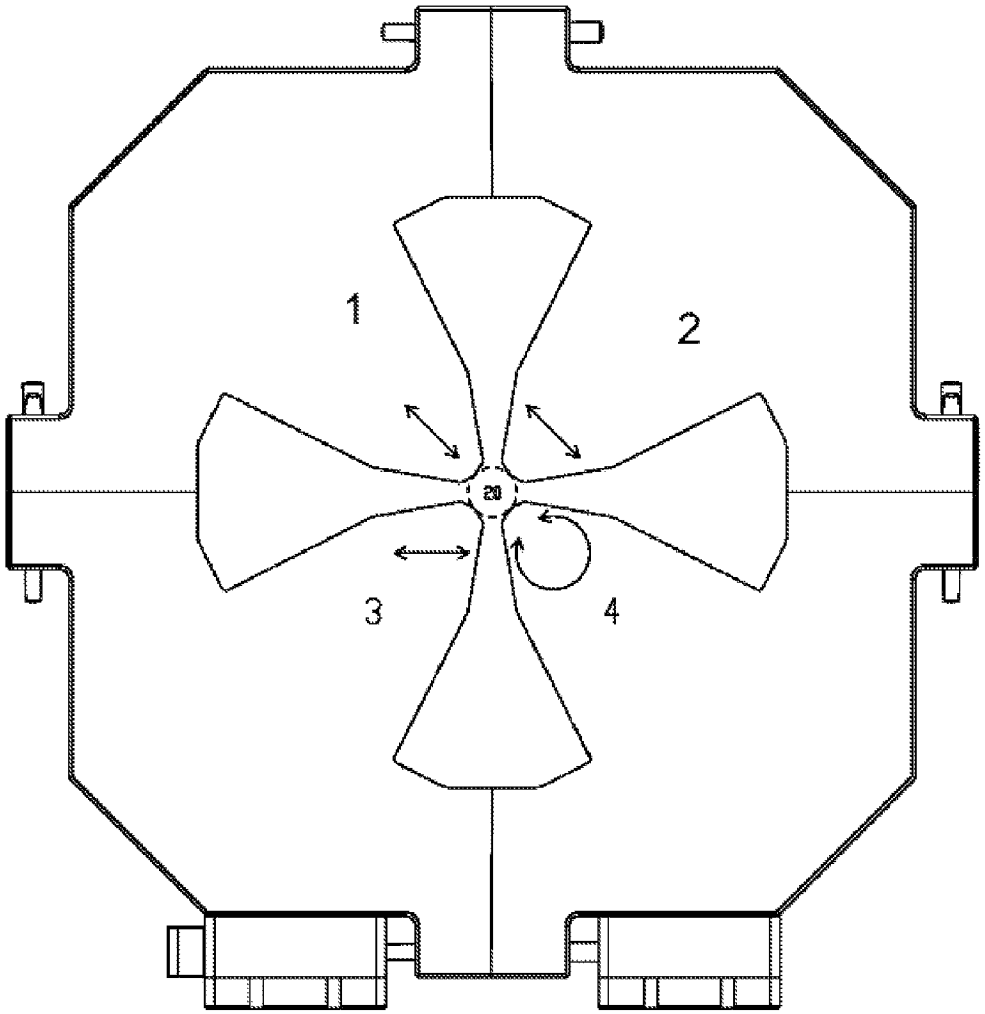
FIG. 1 PRIOR ART
FIG. 1 depicts a prior art quadrupole.
Figure 2A:
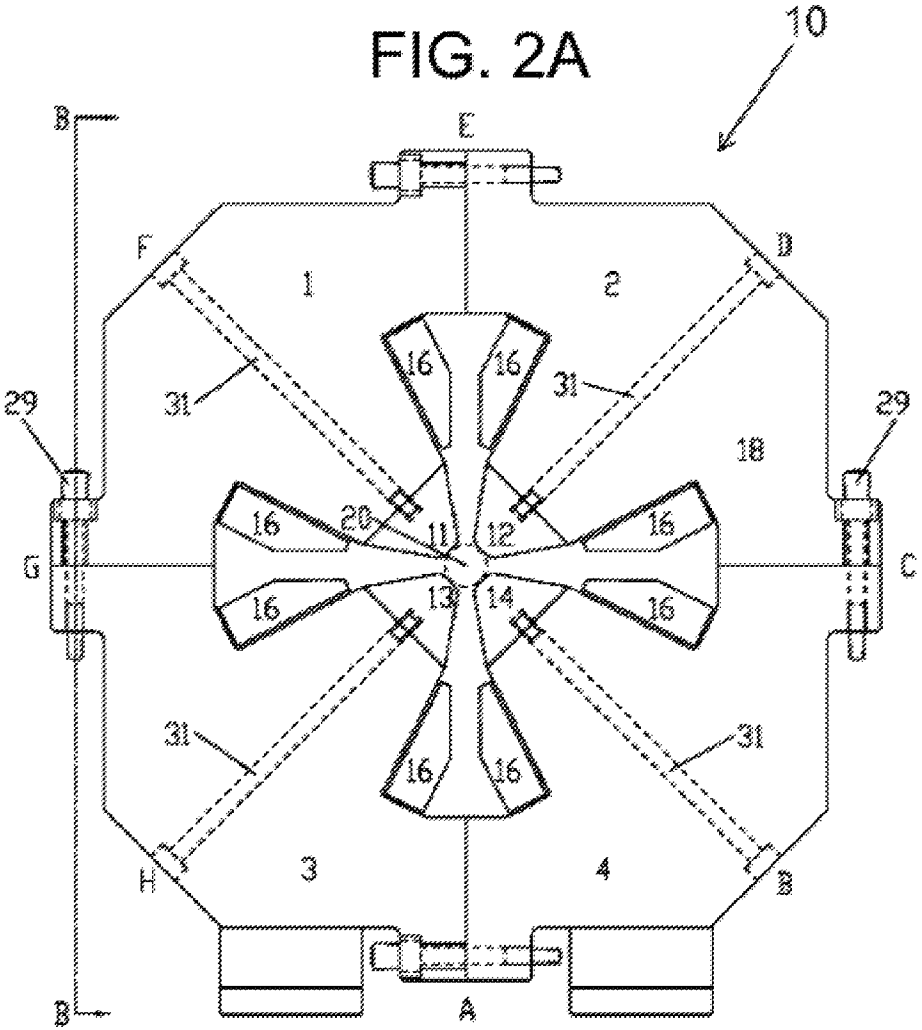
FIG. 2A depicts an eight-piece quadrupole, in accordance with features of the present invention.
Figure 2B:
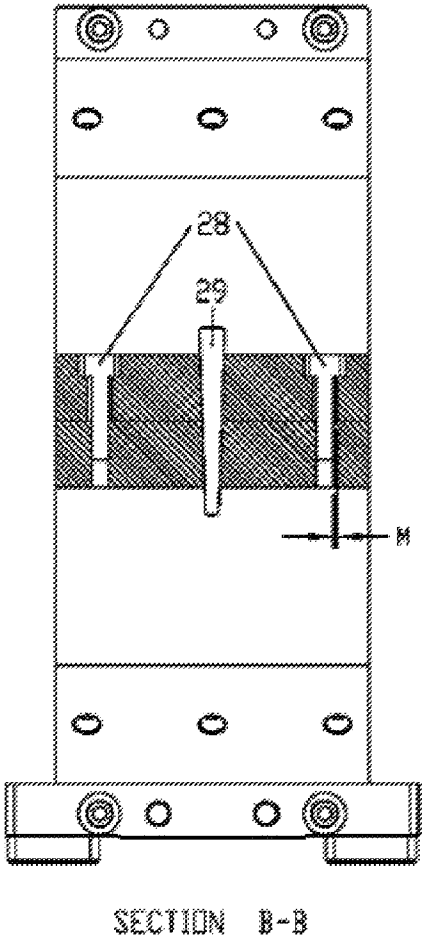
FIG. 2B is a view of FIG. 2A along line B-B.
Figure 5:
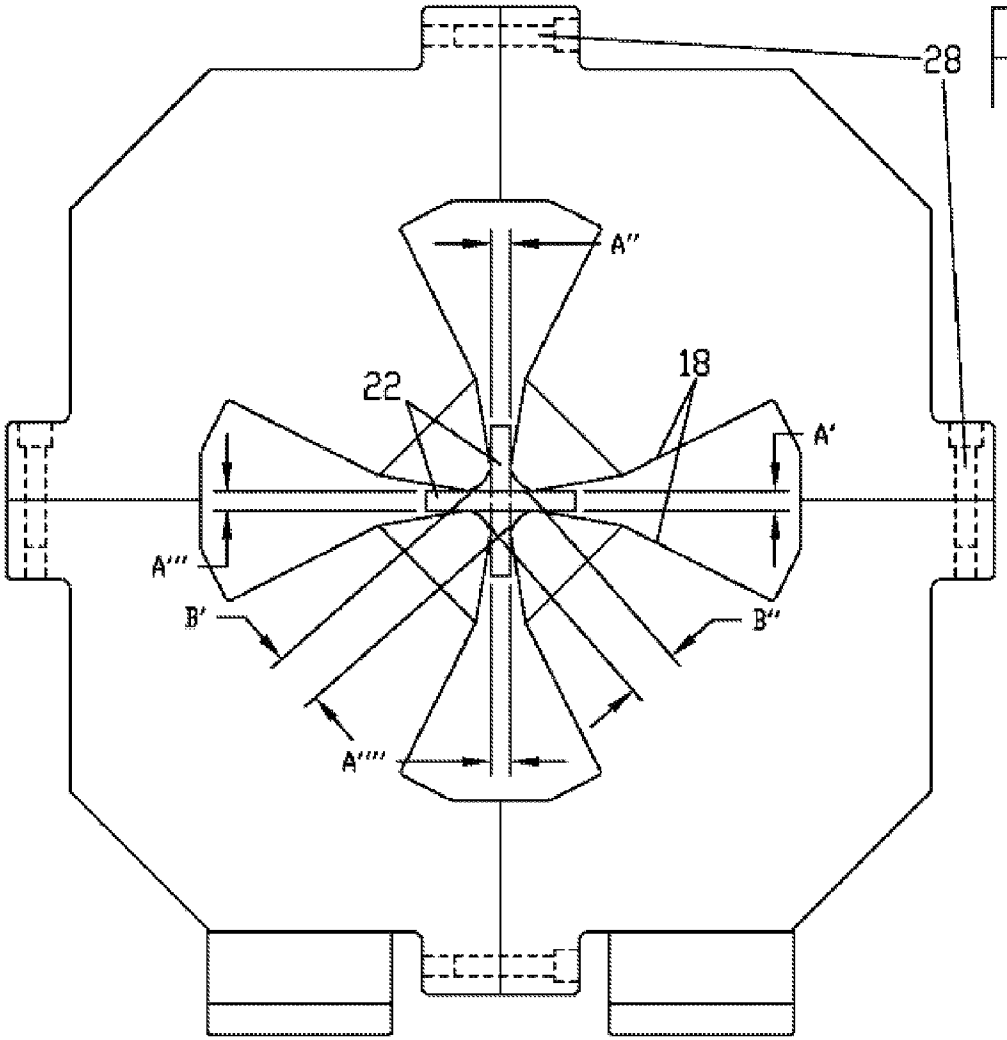
FIG. 5 depicts placement of positioning substrates during quadrupole assembly, in accordance with features of the present invented method.

FIG. 2 depicts an eight-piece quadrupole, designated as numeral 10. The quadrupole comprises four main bodies 1, 2, 3, 4 opposing each other so as to define an aperture 20. The main bodies are removably fastened to each other via a plurality of flanges adapted to receive fasteners 28, as seen in FIGS. 2 and 5. The general shape of the quadrupole is not considered a novel part of the invention, but rather consists of four ferrous substrates representing poles, each pole having a first proximal end adapted to receive electrical windings 16, and a second distal end in opposition with other pole distal ends so as to form an aperture through which a charged particle beam may pass. Materials comprising the poles may include, but are not limited to iron, steel, vanadium permendur, silicon steel laminations, and combinations thereof.

A description of quadrupoles and their fabrication and assembly is found in Tanabe J. T. "Iron Dominated Electromagnets," Magnet Coil Fabrication, 1st Edition, World Scientific Publishing Co. Pte. Ltd, 2005, the entirety of which is incorporated herein by reference.

A salient feature of the invention is that at least one of the main bodies terminates in an adjustable tip. For example, the main body 1 may have an adjustable tip 11 while the three remaining bodies 2, 3, 4 all have static or non-adjustable tips. Alternatively, opposing tips (e.g., 11, 14) may be adjustable while the remaining opposing tips 12, 13 remain static. Those static tips may be removably attached to the poles or perhaps integrally molded with their respective main bodies 2, 3. Yet another alternative is where all of the tips are adjustable. These tips allow for fine tuning of the quadrupole once the latter is assembled. This fine tuning will ensure good field quality, even for quadrupoles machined to standard tolerances.

In an embodiment of the invention, all of the parts of the quadrupole are machined to standard tolerances, but their positioning relative to each other results in tolerances of no more than 10 microns, and often less than 10 microns.

Generally, the invented quadrupole may be comprised of all the same material (e.g., all ferrous material).

Tip Adjustment

Detail

Figure 3:
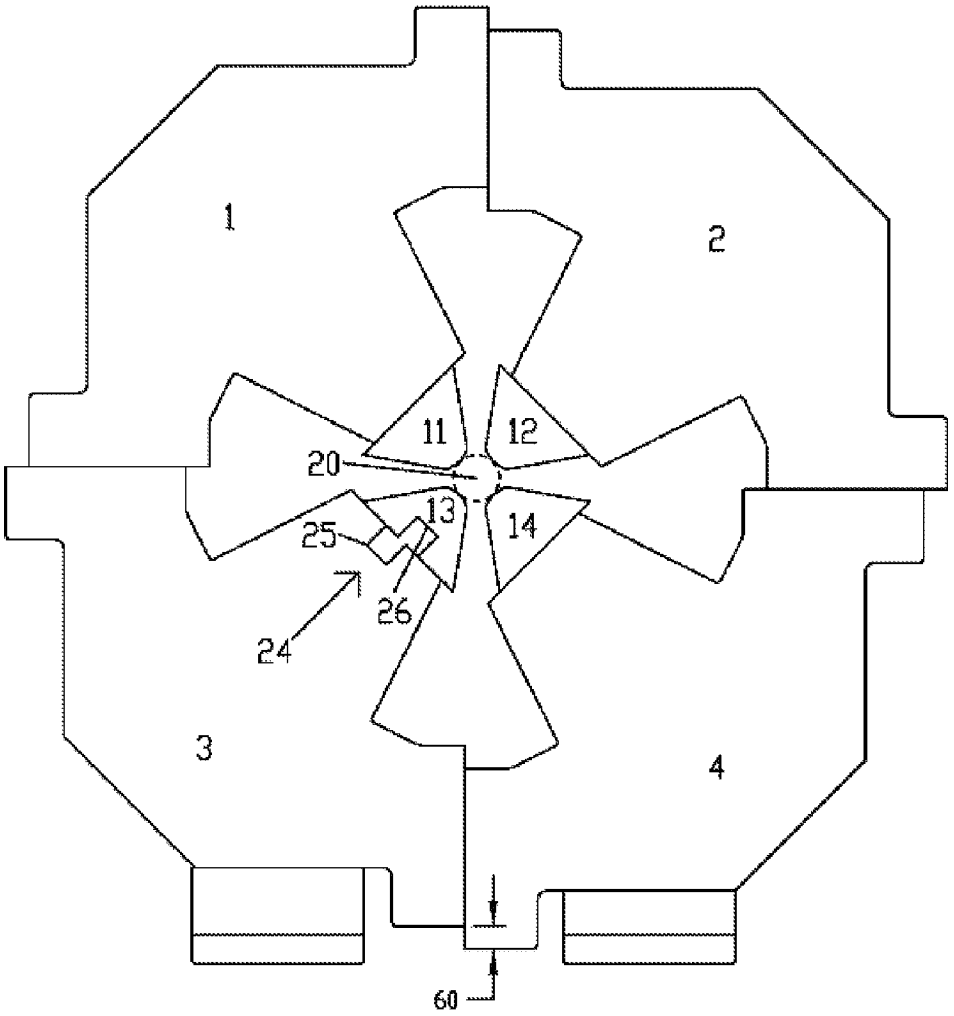
FIG. 3 depicts an eight-piece quadrupole with tips positioned to maintain optimal path geometry, in accordance with features of the present invention.

The following description provides detail for a single adjustable tip 11. However, identical structures may be adopted for more than one of the poles to effect adjustable tips. For example, FIG. 3 depicts a situation whereby a 60-micron misalignment along the vertical and horizontal axes of a quadrupole magnet system is rectified when all four tips 11, 12, 13, 14 are capable of realignment so as to maintain the desired symmetry for the aperture 20. If the two top poles are assembled together, they may move along a vertical mating surface. This confers one degree of freedom, not counting motion in the z axes. One of the lower poles can now be assembled, moving freely along the x-axis, but not in the y-axis. This confers a second degree of freedom. The last pole piece now has no more freedom. It must mate to the existing vertical and horizontal surfaces. Similarly, the pole tips slide along the 45 degree oriented surfaces defined by the distal ends of each of the poles. As such the pole tips each have one degree of freedom. All together, this adjustability confers six degrees of freedom to the system, not counting movement in the z-axis. (In an embodiment of the invention, all the end surfaces are supposed to reside in a single plane as conferred by a an end plate, discussed infra, thereby obviating any freedom of movement along the z-axis.)

Figure 4:
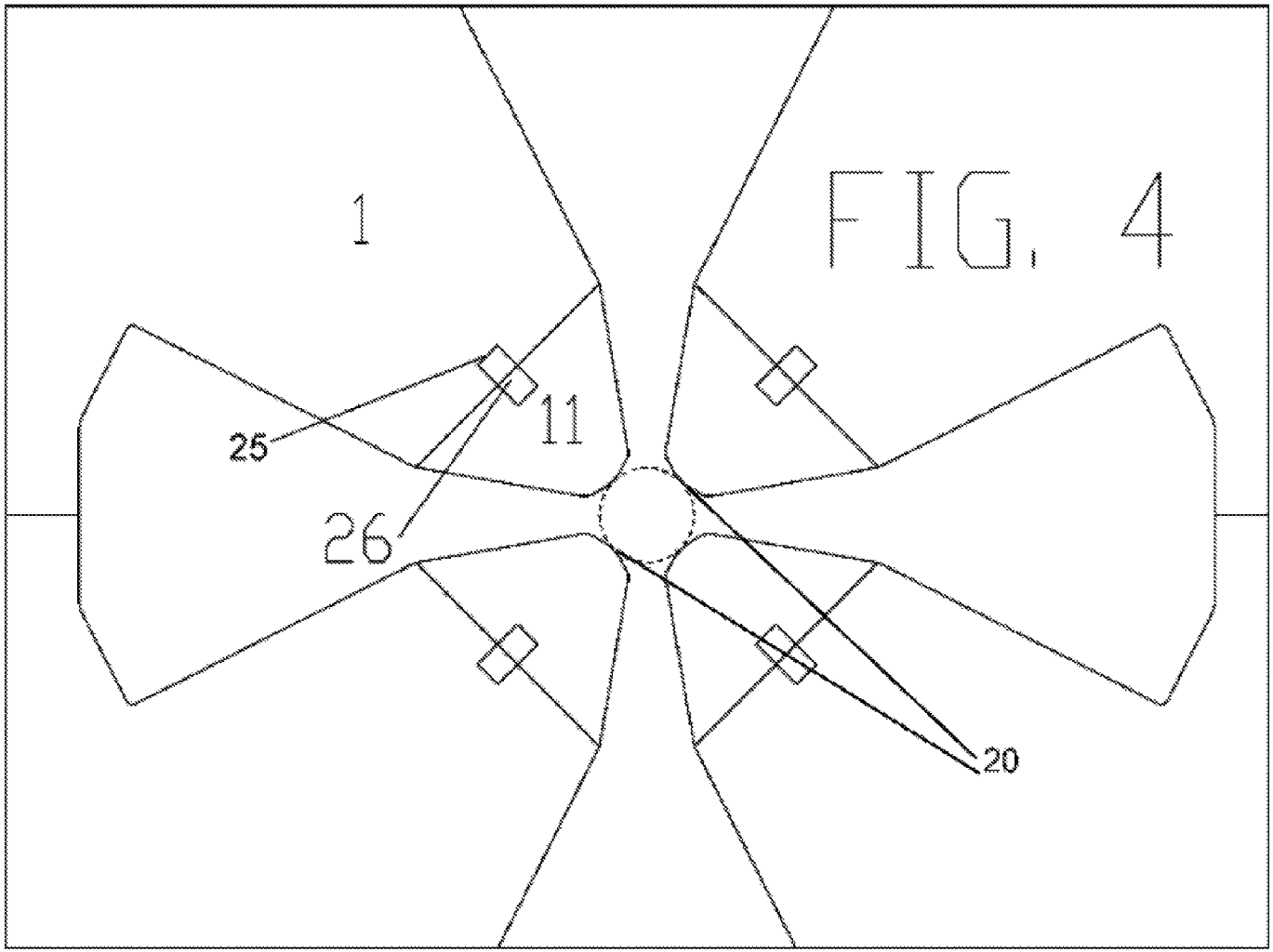
FIG. 4 depicts keyway detail of quadrupole tips, in accordance with features of the present invention.

As depicted in FIG. 3, a keyway 24 is positioned between the tip 13 and its corresponding main body 3. The keyway 24 comprises a first tapered recess 25 formed in the distal-facing surface of the main body 13 and a second recess 26 formed in the proximal facing surface of the tip. The first and second recesses oppose each other such that when they overlap, a closed void is formed. The void is adapted to receive adhesive, such as liquid metal epoxy once the final adjustment of the quadrupole is made. FIG. 4 depicts an alternative embodiment of the keyway configuration wherein no tapered recess 25 exists. In FIG. 4, the keyway of both the tip and the main pole bodies are aligned, wherein the keyways depicted in FIG. 3 are slightly misaligned.

Given the offset configuration depicted in FIG. 3, the two recesses do not perfectly overlap. This allows for adjustment of the tip vis-à-vis its underlying pole to obtain optimal tolerances. Notwithstanding the foregoing, the remaining void is adequate to locate and subsequently cement the tip to the pole via adhesive (e.g., metal epoxy) to maintain optimal magnetic field quality once spacing substrates (discussed infra) are finally removed and the quadrupole is put into service.

In an embodiment of the invention, metal-containing epoxy is used to fill the void formed by the opposing recesses 25, 26 and mold the key within the keyway. As such, the key conforms to the key way and accurately maintains the relative location of the main body and the tip to each other. A feature of the metal epoxy is that it does not shrink or otherwise change shape between its liquid and solid phases so as to effect the symmetry of the particle beam channel 20. Such use of metal epoxy eliminates the need for high precision machining after final assembly, enables high repeatability in positioning the tip, is easy to apply, and is stable in quadrupole environs. Suitable epoxies are commercially available such as the Fixmaster®-brand epoxies (e.g., Loctite®) from Henkel Corporation, Arlington Heights, Ill., USA.

The keyway depicted in FIG. 3 is drafted (tapered) to allow easy removal and re-installation of the key should the pole tip need to be removed or repositioned. As such, at least one of the recesses defines inwardly converging walls such that the floor of the recess is smaller than the mouth of the recess. The keyways depicted in FIGS. 3 and 4 may be formed in all of the poles and the tips defining the charged particle beam channel 20 or fewer than all of the poles and tips.

Assembly Detail

The invented quadrupole configuration enables extremely tight assembly (within 10 microns) of a quadrupole in about a half dozen steps:

- Initially assemble all poles such that each pole directly opposes another pole;
- Measure the gaps that exist between the poles and select separation substrates whose cross section diameters approximate the gaps, minus 10 microns;
- Loosen the assembly to allow insertion of the substrates in the gaps. The substrates are positioned at 90 degree angles to each other such that in position, they necessarily block the particle beam passageway 20. The length of the substrates are chosen for quick insertion and removal in and out of their respective channels;
- Reassemble the quadrupole assuring snug interaction between the pole tips and the spacing substrates;
- Finally fasten pole tips to the poles; and
- Remove the spacing substrates.

An embodiment of the invention provides a method for aligning a quadrupole magnet, the method comprising positioning a first and second pole in opposition to each other, whereby the first pole comprises a first main body terminating in a first adjustable tip and the second pole comprises a second main body terminating in a second adjustable tip, wherein the first main body is collinear with the second main body so as to define a first line extending in a first direction; positioning a third pole comprising a third main body terminating in a third tip and a fourth pole comprising a fourth main body terminating in a fourth tip in opposition to each other such that the third pole and the fourth pole are collinear so as to define a second line extending in a second direction that is generally orthogonal to the first direction so as to form a first channel extending in a third direction between the first pole, second pole, third pole, and fourth pole and a second channel between the first pole, second pole, third pole, and fourth pole extending in a fourth direction that is orthogonal to the third direction; initially fastening the main bodies of the first, second, third and fourth poles to each other in a first adjustment; measuring the first and second channel dimensions, loosening the main bodies and inserting a first spacer substrate in the first channel and a second spacer substrate in the second channel; finally fastening the first, second, third and fourth poles in a rigid construct; and removing the first and second spacer substrates.

In the immediately above-described embodiment, the third tip may be adjustable. The fourth tip may be adjustable. In an embodiment of the method, the first and second substrates are the same size (i.e., cross section). This size is determined by taking the average of the first and second channels, minus approximately 10 microns. This spacing substrate sizing protocol is a means to maintain symmetry of the center aperture 20. In another embodiment, the first spacing substrate has a cross section diameter equal to the average diameter of the first channel minus approximately 10 microns. The second spacing substrate has a cross section diameter equal to the average diameter of the second channel minus approximately 10 microns.

This embodiment may also comprise a means for maintaining the tips in a coplanar relationship to each other. The means for maintaining the tips in a coplanar relationship is utilized before the poles are finally fastened. The means for maintaining the tips in a coplanar relationship comprise the installation of a plate at an upstream end and a downstream end of the quadrupole such that a first surface of each of the plates face inwardly toward the quadrupole and contacts each of the tips.

FIG. 5 provides gap detail for use in assembling the invented eight-piece quadrupole. A first step is to machine all parts to standard machining tolerances. Then, the parts are assembled and the fasteners 28, 31 (FIG. 2) to assemble the quadrupole together are temporarily tightened to the specified torque.

Radially converging surfaces 18 of adjacent poles terminate to form channels A', A", A'", A"" between the sides of the pole tips 11, 12, 13, 14. These channels are measured on one end of the quadrupole. The channel widths are added together, and divided by four to arrive at an average channel distance. Finally, 10 microns (or suitable tolerance depending on size and experience) are subtracted from that average to arrive at the cross diameter of spacing substrates 22 (e.g., gauge blocks) to use on the measured end of the quadrupole assembly. This channel measuring and gauge selection process is repeated at the other end of the quadrupole.

After the distances of the sides of the poles are measured, the gaps B' and B" between opposing tips of the poles are determined. As with the channel measurement process supra, the gap distances are added together and divided by two to arrive at an average. Then, 10 microns (or a suitable tolerance depending on size and experience) are subtracted from this average. This final number is the cross diameter of the gauge pin to place in the center gap 20.

After the channel and gap distances have been determined, all fasteners 28, 31 are loosened. Then, the crisscross spacing substrates and center pin (5 pieces total) are positioned within the channels, as depicted in FIG. 6A, so as to be generally coaxial with their respective channel.

Figure 6B:
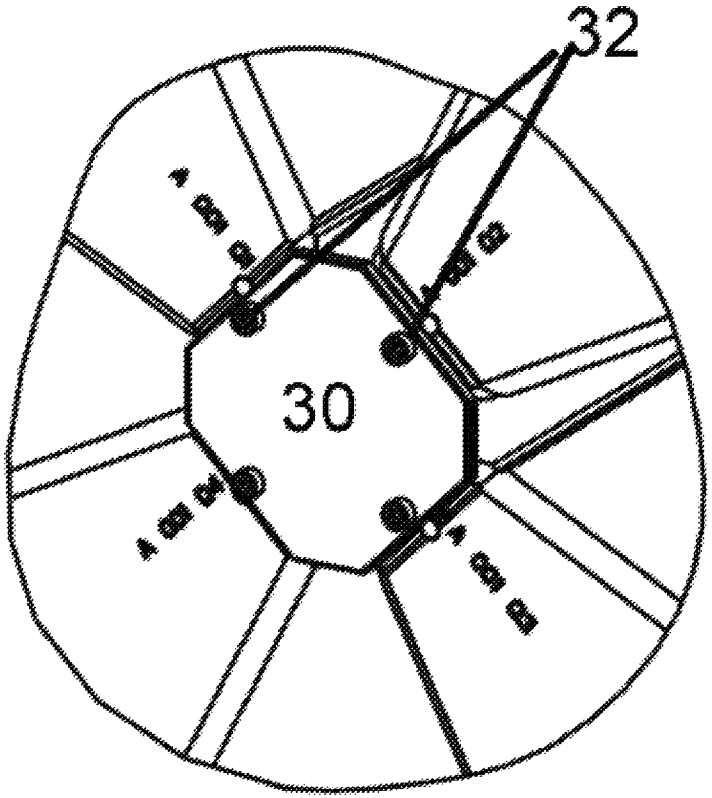
FIGS. 6A and 6B depict placement of endplates to an assembled quadrupole, with FIG. 6A showing the assembled quadrupole magnet without an endplate and FIG. 6B showing the assembled quadrupole magnet with an endplate, in accordance with features of the present invention.
Figure 6A:
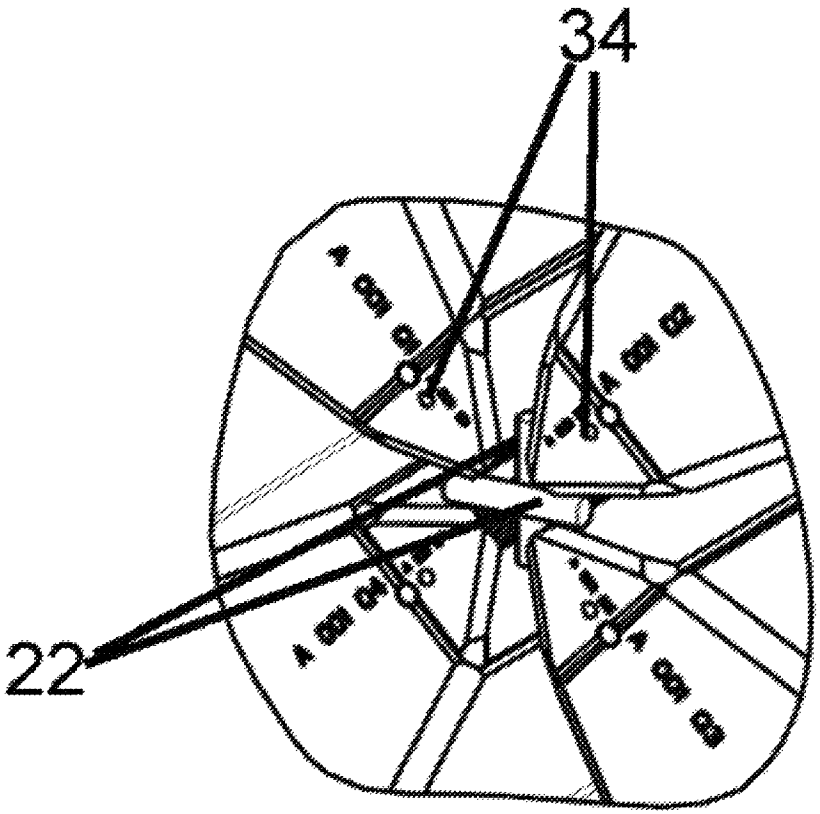

This is followed by the installation of a plate 30, as depicted in FIG. 6B, at one end of the quadrupole. The plate so positioned, defines a surface that resides in a plane generally perpendicular to the charged particle tunnel formed by the quadrupole. Thus, the plate 30 provides a means for holding the pole tips coplanar. As such, the plates are generally flat. Each of the plates 30 define a periphery with regions forming apertures 32 adapted to slidably receive fasteners. The fasteners are matingly received by threaded apertures 34 formed in the distal portions of the main bodies of the poles 1-4.

Once the end plates are installed, all of the fasteners 28, 31 (See FIG. 2) are retightened to the specified tightening torque following incremental steps. Additionally, radially extending fasteners 31, are utilized to fasten the tips 11, 12, 13, 14 to their respective pole main body. The head of each of these radially extending fasteners, once in place, are accessible from the external periphery of each of the pole main body and slidably received by channels coaxially formed within those bodies. The distal ends of those fasteners terminate in threads to matingly engage threaded apertures integrally molded within the proximal ends of their respective tips.

Upon fastener retightening, the gauge blocks, center spacer, and the end plates are removed, and holes for tapered pins 29 are machined in the flanges. Then the tapered pins are mated to their respective holes to finally set the quadrupole.

The field quality in a magnet is determined by the level of unwanted higher order field harmonics. Magnetic inspection is the measurement of higher order field harmonics using a suitable probe, such as a rotating coil system. Surprisingly and unexpectedly, once a magnet is assembled with the invented procedure, it immediately passes magnetic measurement inspection without further adjustments or tuning. Thus, the invented assembly process saves time and money.

A salient feature of the invention is that the pole tips 11-14 may be independently adjusted relative to each other and relative to their respective main pole body. This feature may accommodate a combined function configuration for simultaneously bending and focusing the charged particle beam. In such an arrangement, one tip of an opposing tip pair may slightly jut into the beam path, while the other tip either maintains its regular position or is relatively countersunk into the distal end of its main pole body. This maintains the beam path aperture 20 diameter at that juncture while also providing the field required for bending the charged particle beam.

Figure 7:
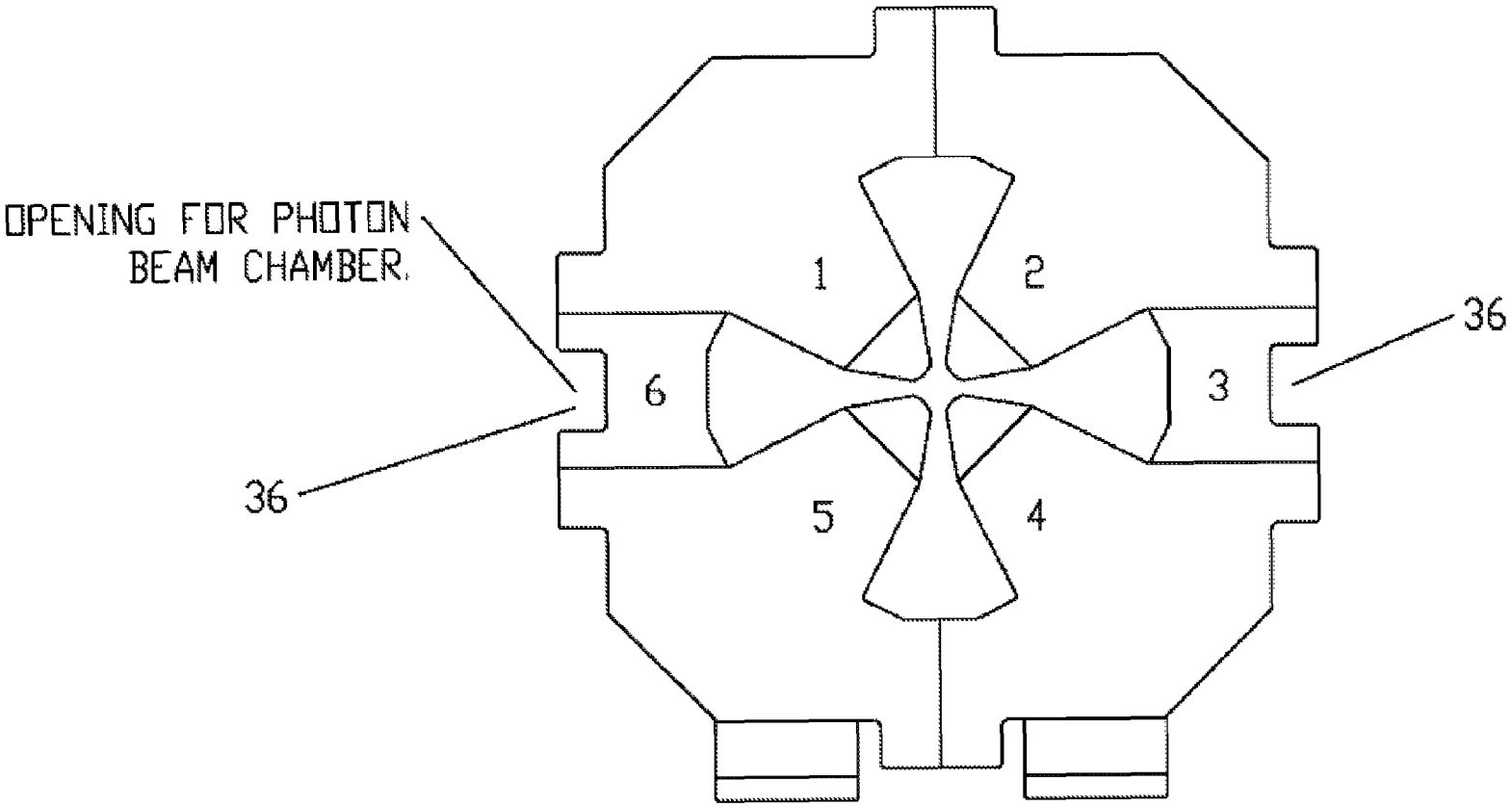
FIG. 7 is a plan view of a 10-piece quadrupole, in accordance with features of the present invention.

FIG. 7 depicts a 10 piece quadrupole magnet design. This configuration features two additional removable main body substrates 3, 6 positioned between the horizontally extending faces of the existing main bodies 1 through 4 depicted in FIG. 2. Substrate 6 may be permanently fastened to substrate 1 or 5 while substrate 3 is permanently fastened to substrate 2 or 4 creating an 8 piece quadrupole.

The 10 piece quadrupole magnet design is provided to accommodate a photon beam chamber 36. FIG. 7 shows peripheries of the additional main body substrates contiguous with the external surfaces of the quadrupole construct. Regions of the peripheries define notches each of which comprises a section of the photon beam chamber 36.

Figure 8:
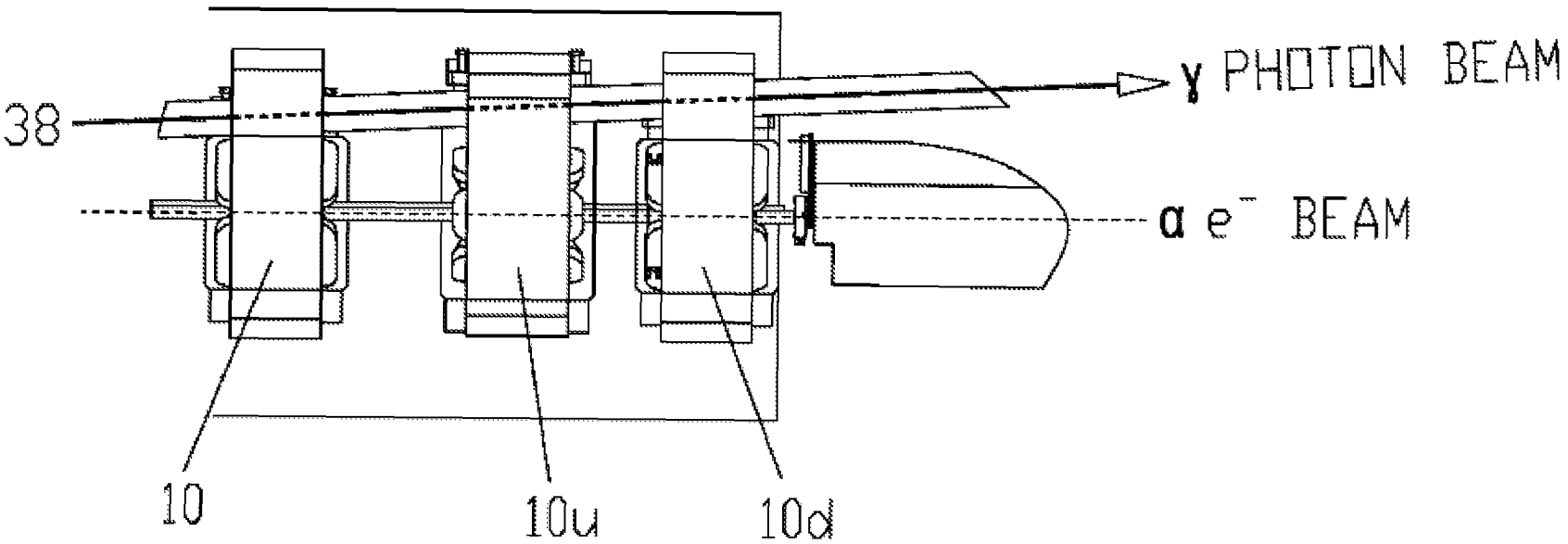
FIG. 8 is a schematic view of a plurality of quadrupoles juxtaposed to a photon beam path, in accordance with features of the present invention.

FIG. 8 depicts a plurality of quadrupoles 10 in collinear relationship with each other. While a photon beam 38 may be somewhat parallel with the longitudinal axis a of the assembly of quadrupoles, its path strikes a chord line at different regions of the peripheries of each of the magnets. As such, the notch 36 (FIG. 7) formed an upstream quadruple 10*u* is positioned in a line of sight, straight path with a notch of a downstream quadrupole 10*d*. The notches may be level with each other so as to reside at the same point on the y axis, or the notches may not be level with each other. In this later scenario, the notches are arranged to enable a photon beam to travel in a straight line which is at an angle to the line defined by an array of quadrupoles.

The two additional main body substrates 3, 6 may also comprise their own dedicated tip to further define the electron beam center aperture 20, thereby producing fields of a combination of multipolarities instead of a pure quadrupole.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. As such, the invention can be applied to 8-piece and 10-piece quadrupoles described herein, or quadrupoles having fewer or more pieces.

While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all sub-ratios falling within the broader ratio. One skilled in the art will also readily recognize that where members are grouped together in a common manner, such as in a Markush group, the present invention encompasses not only the entire group listed as a whole, but each member of the group individually and all possible subgroups of the main group.

Accordingly, for all purposes, the present invention encompasses not only the main group, but also the main group absent one or more of the group members. The present invention also envisages the explicit exclusion of one or more of any of the group members in the claimed invention.

The embodiment of the invention in which an exclusive property or privilege is claimed is defined as follows:

1. A method for aligning a multi-pole magnet, the method comprising:

a) initially positioning a plurality of poles such that each pole directly opposes another pole, thereby forming gaps between the poles;

b) measuring the gaps between the poles and selecting spacing substrates whose cross section diameters approximate the gaps, minus 10 microns;

c) inserting the spacing substrates in the gaps;

d) assembling the multi-pole magnet while simultaneously assuring contact between the poles and the spacing substrates; and e) removing the spacing substrates.

2. The method as recited in claim 1 whereby at least one of the poles comprise an adjustable tip.

3. The method as recited in claim 1 wherein two poles opposing each other comprise adjustable tips.

4. The method as recited in claim 1 further comprising a means for maintaining tips of the poles in a coplanar relationship to each other.

5. The method as recited in claim 4 wherein the means for maintaining the tips in a coplanar relationship is utilized before the poles are assembled.

6. The method as recited in claim 4 wherein the means for maintaining the tips in a coplanar relationship comprise installation of a plate at an end of the multi-pole magnet such that a first surface the plate face inwardly toward the poles and contacts each of the poles.

7. The method as recited in claim 1 wherein a plurality of the poles have separate tips and the tips are fastened to the poles after the assembling step.

8. The method as recited in claim 7 wherein the tips are partially fastened before the spacing substrate is removed.

9. The method as recited in claim 7 wherein the tips are fastened after the spacing substrate is removed.

10. A magnetic quadrupole comprising;

a) a first pole and a second pole in opposition to the first pole such that the first pole and second pole are collinear so as to define a first line, whereby the first pole comprises a first main body with a distal end terminating in an adjustable first tip and the second pole comprises a second main body with a distal end terminating in an adjustable second tip; and b) a third pole comprising a third main body with a distal end terminating in a third tip and a fourth pole comprising a fourth main body with a distal end terminating in a fourth tip in opposition to each other such that the third pole and the fourth pole are collinear so as to define a second line that is generally orthogonal to the first line so as to form a first channel extending between the first pole, second pole, third pole, and fourth pole and a second channel between the first pole, second pole, third pole, and fourth pole wherein the second channel is orthogonal to the first channel.

11. The magnetic quadrupole as recited in claim 10 wherein the third tip is adjustable.

12. The magnetic quadrupole as recited in claim 10 wherein the fourth tip is adjustable.

13. The magnetic quadrupole as recited in claim 10 wherein the first tip interacts with the first main body via a keyway.

14. The magnetic quadrupole as recited in claim 10 wherein the second tip interacts with the second main body via a keyway.

15. The magnetic quadrupole as recited in claim 10 wherein the third tip interacts with the third main body via a keyway.

16. The magnetic quadrupole as recited in claim 10 wherein the fourth tip interacts with the fourth main body via a keyway.

17. The magnetic quadrupole as recited in claim 10 further comprising a fifth main body removably positioned between the first main body and the third main body and a sixth main body removably positioned between the second main body and the fourth main body, each of said fifth main body and sixth main body defining a periphery continuous with an exterior surface of the quadrupole.

18. The magnetic quadrupole as recited in claim 17 wherein the periphery defines a notch to accommodate passage of a photon beam.

19. The magnetic quadrupole as recited in claim 10 wherein the quadrupole has 6 degrees of freedom.

20. The magnetic quadrupole as recited in claim 19 wherein the first main body, the second main body, the third main body and the fourth main body each have a proximal end adapted to receive windings.

* * * * *